US005996777A

United States Patent [19]

Capers, III

[11] Patent Number: 5,996,777

[45] Date of Patent: Dec. 7, 1999

[54] DETONATOR PACKAGING

[75] Inventor: John E. Capers, III, McArthur, Ohio

[73] Assignee: Austin Powder Company, Cleveland, Ohio

[21] Appl. No.: 09/226,362

[22] Filed: Jan. 6, 1999

Related U.S. Application Data

[62] Division of application No. 08/978,092, Nov. 25, 1997, Pat. No. 5,873,455, which is a continuation of application No. 08/560,865, Nov. 20, 1995, abandoned.

[51] Int. Cl.[6] ..... F42B 39/00

[52] U.S. Cl. ..... 206/3; 206/588

[58] Field of Search ..... 206/3, 523, 588, 206/589, 590, 592; 89/34; 102/331, 467, 466

[56] References Cited

U.S. PATENT DOCUMENTS

| | | |
|---|---|---|
| Re. 33,446 | 11/1990 | Levey, Sr. . |
| 1,986,421 | 1/1935 | Windfuhr . |
| 2,346,792 | 4/1944 | Rush . |
| 2,601,919 | 7/1952 | Darbyshire . |
| 2,782,911 | 2/1957 | Fisher . |
| 2,868,360 | 1/1959 | Donkin . |
| 2,959,340 | 11/1960 | Hennessey . |
| 3,206,015 | 9/1965 | Zimmer . |
| 3,713,360 | 1/1973 | Shansey . |
| 4,027,417 | 6/1977 | Swatek . |
| 4,199,057 | 4/1980 | Gruaz . |
| 4,222,484 | 9/1980 | Howe . |
| 4,334,476 | 6/1982 | Day et al. . |
| 4,586,602 | 5/1986 | Levey . |
| 4,763,576 | 8/1988 | Kass et al. . |
| 4,895,249 | 1/1990 | Davis et al. . |
| 5,133,258 | 7/1992 | Rock et al. . |
| 5,158,173 | 10/1992 | Halsey et al. . |
| 5,390,580 | 2/1995 | Gibbons, Jr. et al. . |
| 5,494,152 | 2/1996 | Sobczak et al. . |
| 5,585,591 | 12/1996 | Waldock . |
| 5,873,455 | 2/1999 | Capers, III ..... 206/3 |

*Primary Examiner*—David T. Fidei
*Attorney, Agent, or Firm*—Fay Sharpe Fagan Minnich & McKee

[57] ABSTRACT

Detonator packaging comprising a casing, a carton for retaining a plurality of casings and spacers for separating and organizing the casing within the carton is disclosed. The casing is formed from a plurality of connected sections of relatively dense material, such as Homeosote. The casing preferably includes two end sections and one or more interior sections retained, or sandwiched, between the two end sections. An opening, or bore, extends through one of the end sections and into one or more of the interior sections. A detonator having an explosive end is inserted into the opening so that the explosive end is retained at least partially within one of the interior sections. A carton is preferably formed of corrugated cardboard and is large enough to hold a plurality, preferably about one hundred fifty, of the casings. Paper or cardboard spacers are used to space the casings from transmission tubes retained within the carton. Each casing is preferably adhesively attached to the center of the spacer so as to maintain the casing, which includes the detonator, a fixed distance from the transmission tubes.

9 Claims, 5 Drawing Sheets

DETONATOR PACKAGING

This is a divisional application of application U.S. Ser. No. 08/978,092, now U.S. Pat. No. 5,873,455 filed Nov. 25, 1997, which is a file-wrapper continuation of U.S. Ser. No. 08/560,865, filed Nov. 20, 1995, now abandoned.

FIELD OF THE INVENTION

The present invention relates generally to packaging for explosives and more particularly to packaging for detonators.

BACKGROUND OF THE INVENTION

As a safety precaution, explosive devices are generally packaged before being shipped. If one of the explosive devices explodes, the packaging is supposed to prevent the explosive force from being transmitted to surrounding structures and personnel, thereby preventing damage to both. In particular, the packaging is supposed to prevent the explosive force of a single detonation from initiating other explosive devices in the same shipment, which may start a chain reaction leading to mass detonation. As used by those skilled in the art, the term initiate means to fire, or explode, an explosive device.

As is known by those skilled in the art, the relative safety of packaged explosives is measured according to United Nations Certification numbers or classifications. Most detonators are in class 1.1B which means that they can mass detonate and, therefore, they must be shipped separately from other hazardous materials (except for materials having the same classification number). A 1.4B classification means that the explosives will not mass detonate and that they can be shipped with other hazardous materials. As it will be understood, products having a 1.1B classification are much more expensive to ship than products having a 1.4B classification, because they must be shipped on a truck separate from other explosives. An even more desirable classification is 1.4S, which means that the product can be shipped on commercial air-craft.

Several types of containers or packages for explosives are known that comprise layers of absorbent foam and/or metal barriers to contain an explosive force. None of these devices are practical for packaging detonators because they are expensive, whereas detonators are relatively low-cost items. Further, because of the complexity of many of the known packaging designs, they could not be produced in a size suitable for packaging a detonator, which is generally about 3 inches long and has a diameter of approximately ⅜ inches. Additionally, many of the explosives packages disclosed in the prior art are relatively heavy, which makes the assembled, packaged product difficult to handle and expensive to transport.

Generally, detonators are packaged by first layering a cardboard carton with ½" thick Homeosote. A 1" thick section of Homeosote is then provided and about 10–15 holes are bored in this Homeosote section. A detonator, having an explosive end, is then placed in each hole so that the explosive end is contained within the hole. A plurality of these boards containing detonators are placed in the carton with ½" thick Homeosote sheets placed between them. This type of packaging is relatively heavy and it does not adequately contain the explosive force of the detonator and, therefore, does not adequately prevent mass detonations. Additionally, it greatly reduces the available space within the carton. Therefore, each carton contains a relatively small number of detonators and transportation costs are increased.

Detonators are rated according to explosive force. A number 8 detonator has the lowest explosive force and a number 12 detonator has the highest explosive force. Using the packaging methods known in the prior art, it has been possible to achieve a 1.4B classification with number 8 detonators, but a 1.4B classification has not be achieved with more powerful detonators in a cost-effective manner and a 1.4S classification has never been achieved with detonators in a cost-effective manner.

SUMMARY OF THE INVENTION

The present invention solves these and other problems by providing a low-cost packaging that is light weight, easy to manufacture and that holds a relatively large number of detonators in a single carton.

The invention comprises a casing for containing the explosive end of a detonator. The casing is formed from a plurality of sections of relatively dense material, such as Homeosote, that are connected, preferably by an adhesive. Preferably, the casing comprises three or more material sections, although it could also be formed from two sections. Two of the sections form ends or sides of the casing and are called end sections and the other material sections are retained, or sandwiched between the end sections and are called interior sections. An opening is formed in the casing and a detonator, or other explosive device, is received in the opening so that the explosive end is retained at least partially within one of the interior sections. The casing absorbs most or all of the explosive force of the detonator and prevents the explosive force from initiating other detonators in the package.

Each detonator preferably has a length of transmission tube, detonating cord or wire attached thereto. In order to retain the casing a fixed distance from the transmission tube or detonator, the casing is placed in a cardboard spacer before being placed in the carton.

It is therefore an object of the present invention to provide packaging for shipping explosives.

Another object of the present invention is to provide packaging for shipping detonators.

It is further object of the present invention to provide packaging for shipping detonators wherein the explosion of one detonator will not cause other detonators within a carton to explode.

It is a further object of the present invention to provide detonator packaging comprising a casing formed from a plurality of material sections wherein the casing has an opening that extends into an interior material section. A detonator is inserted into the opening and is retained at least partially within the interior material section.

It is a further object of the present invention to provide detonator packaging comprising a casing as described above attached to a spacer.

It is a further object of the present invention to provide detonator packaging comprising a carton containing a plurality of spacers each of which has a detonator attached thereto as described above.

These and other objects will become apparent to those skilled in the art upon reading the following description and appended claims.

DETAILED DESCRIPTION OF THE INVENTION

Figure 1:
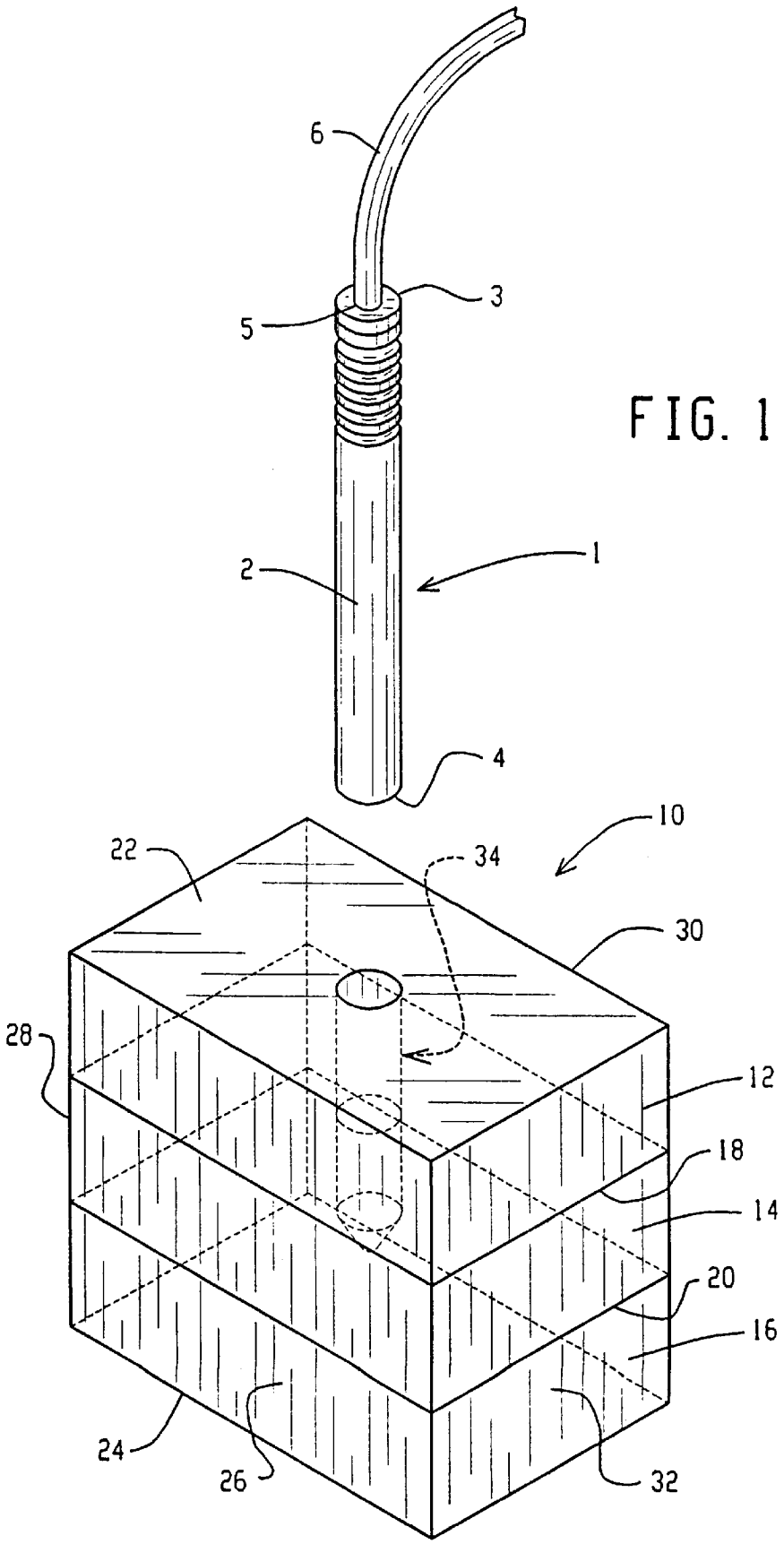
FIG. 1 is a perspective view of the casing according to the present invention.

Turning now to the drawings, where the purpose is to show a preferred embodiment of the invention, and not to limit same, FIG. 1 shows a detonator 1 and a nonpropagation casing 10 according to the present invention. Detonator 1 is generally an elongated, cylindrical member. Detonator 1 has an exterior casing 2, which is preferably formed of metal such as aluminum or steel, a first end 3 and a second end 4. First end 3 has an opening 5 formed therein, opening 5 being dimensioned to receive a transmission tube or detonating cord 6. The interior (not shown) of detonator 1 has a series of explosive charges that can be initiated by transmission tube 6. The series of charges culminates in a high-energy explosive charge retained within second end 4. Second end 4, therefore, is also referred to as the explosive end of the detonator.

Casing 10 is preferably formed of a material having a density of 26 lbs./ft$^3$ to 28 lbs./ft.$^3$ and is preferably formed from sections of Homeosote. Other paper products, wood or plastics could also be used. Less dense materials, such as corrugated cardboard or pressed paper would not adequately contain the explosive force when assembled in the configurations described herein. Additionally, these materials create a fire hazard.

Preferably casing 10 is formed of three layers, or material sections, 12, 14, 16, although two, or more than three, material sections could be used. Material sections 12 and 16 are referred to as end sections, because they each form an end, or side, of casing 10. Material section 14 is referred to as an interior section because it is retained, or sandwiched, between end sections 12 and 16.

Figure 2:
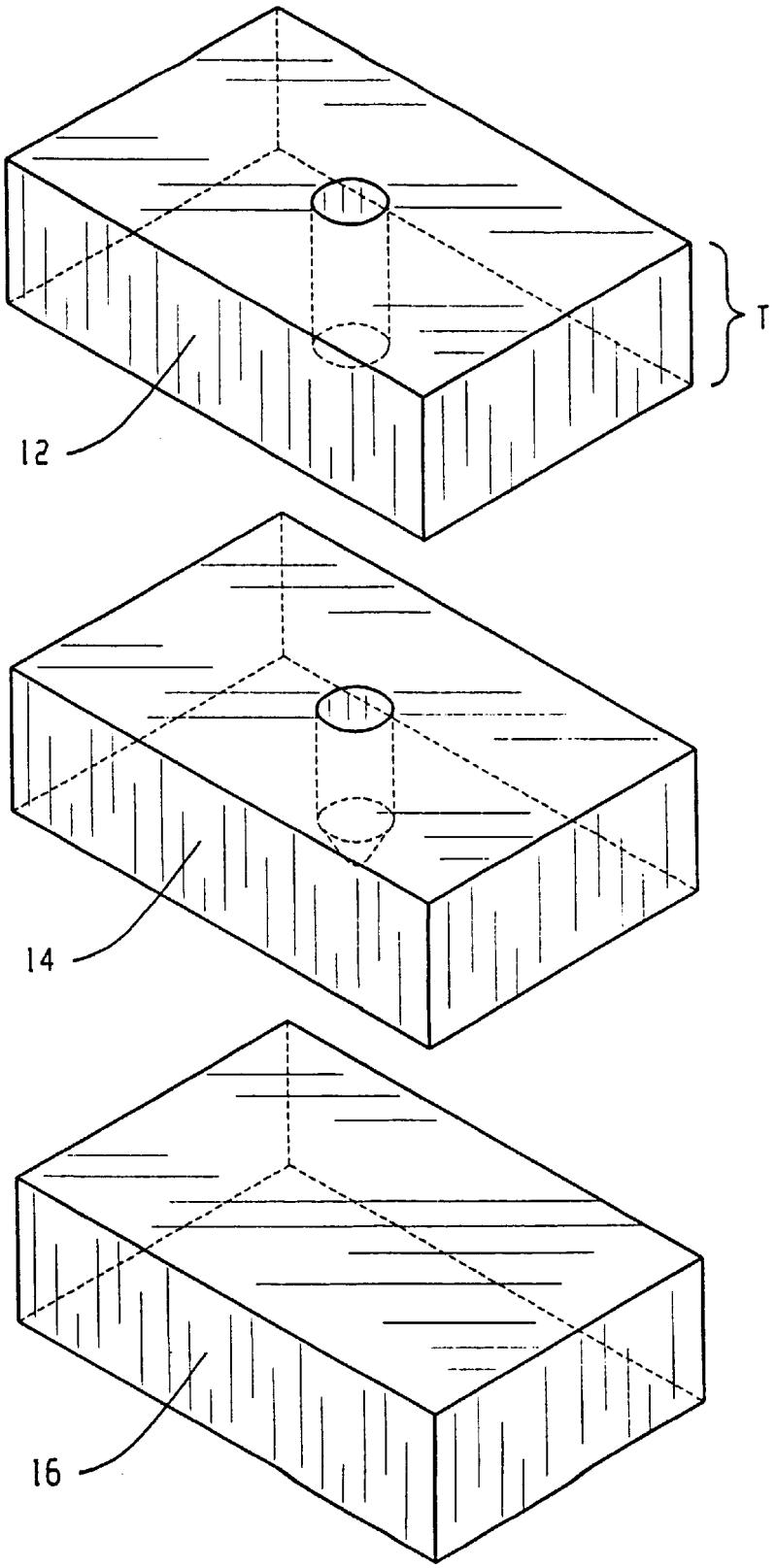
FIG. 2 is an exploded, perspective view of the casing shown in FIG. 1.
Figure 3A:
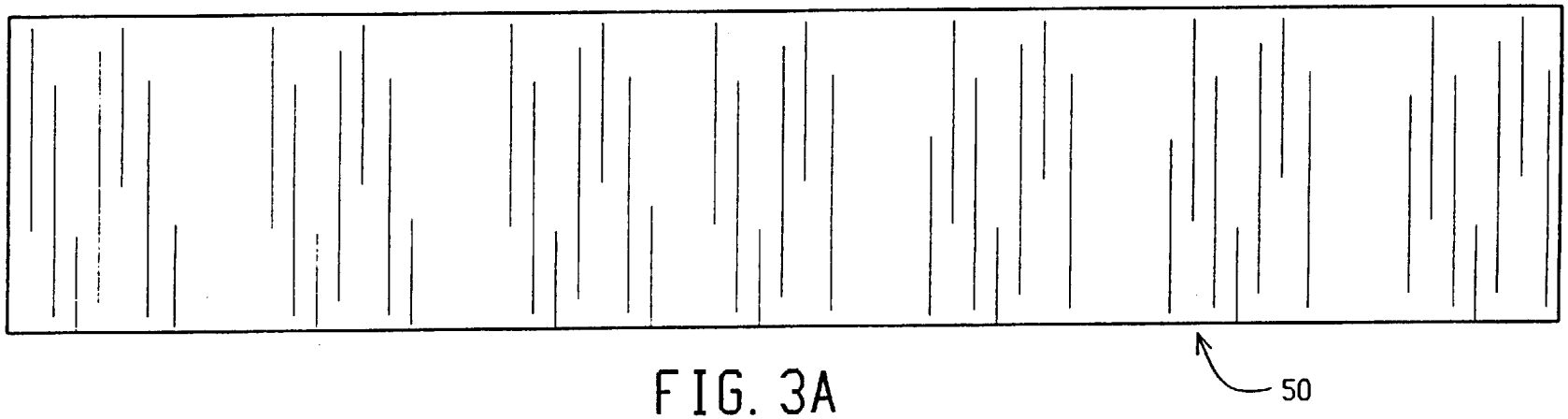
FIG. 3 shows a front, bottom and assembled bottom view of a spacer according to the present invention.
Figure 3B:
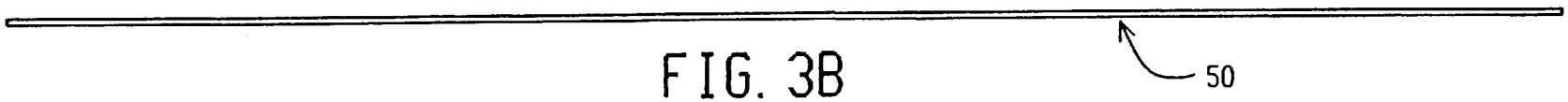
Figure 3C:
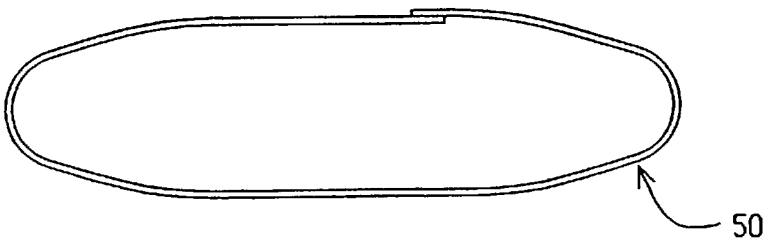

Referring to FIG. 2 material section 12 preferably is rectangular and preferably has a nominal dimension of 1-½"×1" and a nominal thickness T of ½". It will be understood, however, that material sections having any dimensions capable of absorbing the explosive force of the explosive device could be used. The material sections used to form the present invention preferably all have the same dimensions and thickness, as this lends for simple manufacture and assembly, however, material sections having different dimensions and thicknesses could also be used. Therefore, in the preferred embodiment sections 14 and 16 have the same dimensions and thickness as section 12.

Material sections 12 and 14 are connected by an adhesive (not shown) disposed at intersection 18. Material sections 14 and 16 are preferably connected by an adhesive (not shown) disposed at intersection 20. Any adhesive capable of bonding material sections 12, 14 and 16 could be used. The adhesive will be selected according to the material that forms sections 12, 14 and 16. Additionally, other connecting structures could be employed to connect sections 12 and 14 and 14 and 16. The adhesive connecting the material sections that form casing 10 is preferably a two-sided adhesive tape.

Casing 10 has a first end 22, a second end 24 and sides 26, 28, 30 and 32. An opening 34 is generally elongated, cylindrical and preferably extends from first end 22 through sections 12 and 14, but does not penetrate section 16. In order for casing 10 to adequately absorb the explosive force of the detonator, the explosive end of the detonator should be positioned in an interior section, which is section 14 on casing 10. It will be understood, however, that depending upon the thickness and density of the material sections forming the casing, it is not always necessary that the explosive end of the detonator be positioned entirely within center section 14. It is only necessary that enough of the explosive end of the detonator be positioned within center section 14 to keep casing 10 from fragmenting and possibly initiating other detonators. Therefore the explosive end of the detonator may be positioned partially within section 12 and/or 16 (depending on the thickness of the sections and the length of the explosive end). Additionally, if there is more than one interior section (for example, if casing is formed of four or more sections) opening 34 should extend at least partially into at least one of the interior sections. The explosive end of the detonator may be positioned partially within one or more of the interior sections. If the casing is formed of only two material sections, opening 30 should extend through one material section and at least partially into the second material section so that the explosive end of the detonator is positioned partially within each of the material sections.

As shown in FIG. 1, sections 12, 14 and 16 are horizontally arranged to form casing 10. Alternatively, as shown in FIG. 5, sections 12', 14'and 16'are vertically arranged and connected in the manner previously described to form a casing 10'. In this arrangement, an opening 34'is formed in the center section 14'and not in the two end sections 12 and 16. Additionally, only two blocks or more than three blocks may be vertically arranged and connected to form a casing in accordance with the present invention. Furthermore, other arrangements of connected material sections may also be used. Some examples are shown in FIG. 5.

Figure 4:
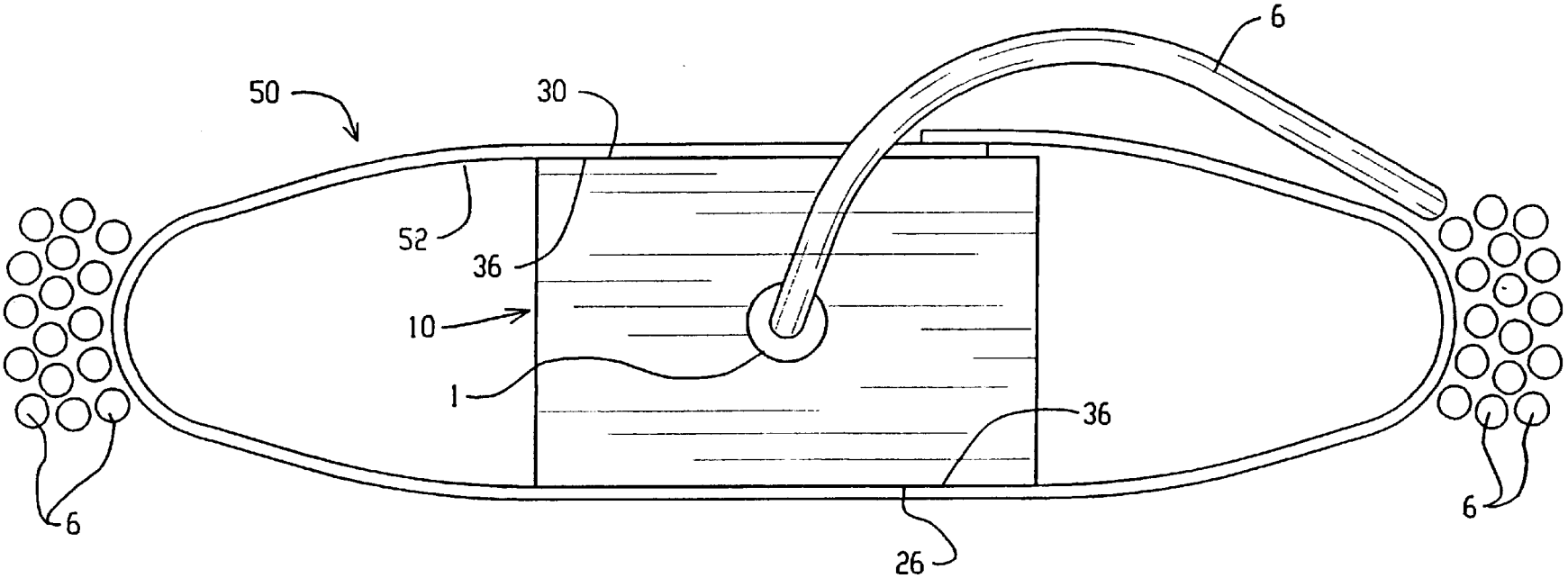
FIG. 4 shows a spacer separating the casing from transmission tubes.
Figure 5A:
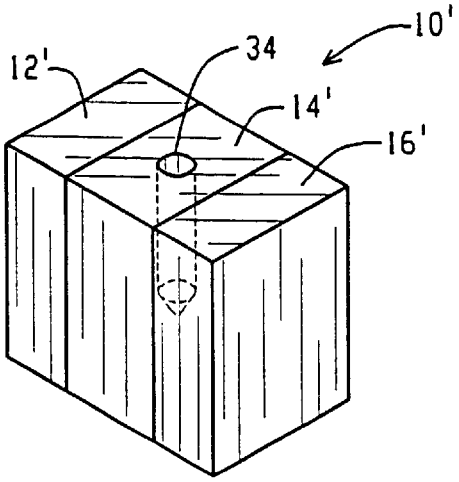
FIG. 5 shows alternate casing structures in accordance with the present invention.
Figure 5B:
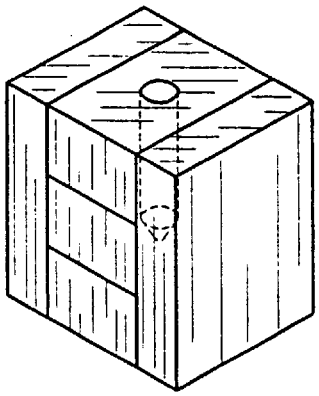
Figure 5C:
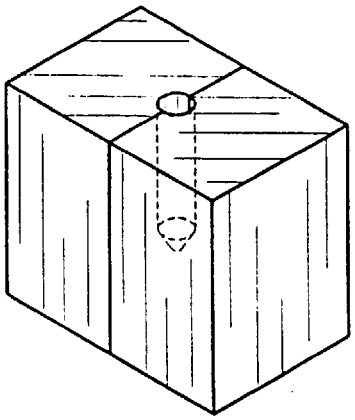
Figure 5D:
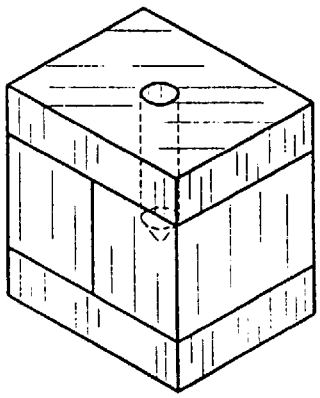
Figure 5E:
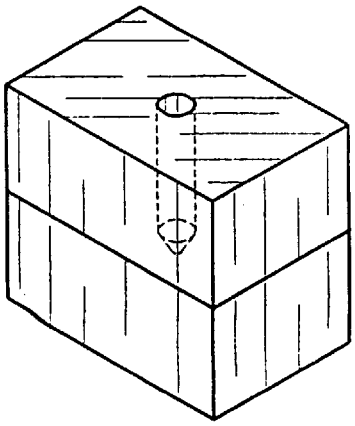

As shown in FIG. 4, a spacer 50 is preferably made of pressed paper or cardboard, although other materials could be used. Spacer 50 is generally a single strip of material that is wrapped so that the ends overlap and glued to a loop. In this way a plurality of nonpropagation casings 10 may be neatly arranged and separated from one another. A casing 10 having a detonator 1 and transmission tube 6 is preferably connected to interior wall 52 of spacer 50. Preferably an adhesive (not shown) is applied to side 26 of casing 10. Adhesive 36 is preferably a two sided adhesive tape. Side 26 of casing 10 is attached to wall 52 of spacer 50 by the adhesive, although other means of attachment may be used. Additionally, side 30 may be attached to the opposite side of interior wall 52. The purpose of attaching casing 10 to wall 52 is to further protect against mass detonation. If detonator 1, retained within opening 34 of casing 10, explodes, a small amount of shrapnel and energy may escape from casing 10. If casing 10 was improperly packed or has shifted during shipping it may be in close proximity with the transmission tubes. In that case even a small amount of explosive force could possibly initiate the transmission tube, which would initiate the other detonators to which the transmission tube is connected. By attaching casing 10 to wall 52, it insures that the detonator remains spaced from the transmission tubes during shipping. Preferably, each casing is centered on a wall 52 within a 3"space formed between a coil of transmission tube. Therefore, detonator 1 is preferably spaced 1-½" from a transmission tube, although other spacings could also achieve the desired result. This same result could be accomplished by dimensioning the casing (e.g., making it wider) so that a space is maintained between the casing and the transmission tubes.

A carton (not shown) is preferably a corrugated cardboard box dimensioned to receive a plurality of spacers 50 having casings 10, detonators 1 and transmission tubes 9. Preferably the carton is dimensioned to contain 150 spacers 50 and, therefore, 150 detonators 1.

Having now described a preferred embodiment of the invention, modifications and alterations that do not depart from the spirit of the invention will become apparent to those skilled in the art. The invention is, therefore, not limited to this description, but is instead set forth in the following claims and legal equivalents thereof.

What is claimed is:

1. An explosives package comprising:

(a) a plurality of casings, each of said casings including a plurality of attached material sections, each of said material sections being formed of solid cellulosic material having a density of 26 lbs/ft$^3$ or greater, and each of said casings having a single opening formed therein;

(b) a plurality of detonators substantially equal to the number of said casings, each of said detonators having an explosive end positioned within said opening in one of said casings.

(c) a plurality of spacers substantially equal to the number of casings, each of said casings being attached to a spacer, and (d) a container housing said spacers, said casings, and said detonators.

2. An explosives package as defined in claim 1, wherein each of said casings is attached to the center of its respective spacer.

3. An explosives package as defined in claim 1, wherein each of said spacers is made of cardboard.

4. An explosives package comprising:

a plurality of detonators, each of said detonators having a first end from which a transmission tube extends and a second end containing an explosive charge, said transmission tube being arranged in a coil;

a plurality of casings at least equal in number to said detonators, each of said casings including a plurality of attached material sections, each of said material sections being formed of solid cellulosic material having a density of 26 Ibs/ft$^3$ or greater, and each of said casings having an opening formed therein, each of said detonators having its second end positioned within said opening of one of said casings; and a spacer attached to each of said casings and interposed between its respective casing and said transmission tube coil of said detonator associated with its respective casing.

5. An explosives package as defined in claim 4, wherein wherein each of said spacers is a strip of cardboard encircling its respective casing.

6. An explosives package as defined in claim 4, wherein each of said spacers is configured and dimensioned to separate said opening of its respective casing from said transmission tube coil of said associated detonator by a distance of about 1 ½ inches or more.

7. An explosives package comprising:

a plurality of detonators, each of said detonators being substantially tubular in shape and having a first end from which a transmission tube extends and a second end containing an explosive charge, said transmission tube being arranged in a coil;

a plurality of casings at least equal in number to said detonators, each of said casings consisting of two end material sections and an interior material section sandwiched between said end material sections, each of said material sections being formed of solid cellulosic material having a density of 26 lbs/ft$^3$ or greater, and each of said casings having an cylindrical opening formed therein, each of said detonators having its second end positioned within said opening of one of said casings; and a spacer attached to each of said casings and interposed between its respective casing and said transmission tube coil of said detonator associated with its respective casing.

8. The explosive package as defined in claim 7, wherein said cylindrical opening extends through only one of said end material sections and into said interior material section.

9. An explosives package as defined in claim 7, wherein each of said spacers is configured and dimensioned to separate said opening of its respective casing from said transmission tube coil of said associated detonator by a distance of about 1½ inches or more.

* * * * *